US007439946B2

(12) United States Patent
Nakayama et al.

(10) Patent No.: US 7,439,946 B2
(45) Date of Patent: Oct. 21, 2008

(54) LIQUID CRYSTAL DISPLAY DEVICE WITH CONTROLLED POSITIVE AND NEGATIVE GRAY SCALE VOLTAGES

(75) Inventors: Takanori Nakayama, Mobara (JP); Tsuyoshi Uchida, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 1006 days.

(21) Appl. No.: 10/797,124

(22) Filed: Mar. 11, 2004

(65) Prior Publication Data

US 2004/0223006 A1 Nov. 11, 2004

(30) Foreign Application Priority Data

Mar. 13, 2003 (JP) ..... 2003-067978

(51) Int. Cl.
*G09G 3/36* (2006.01)

(52) U.S. Cl. ..... 345/89; 345/690

(58) Field of Classification Search ..... 345/87, 345/89, 94, 96, 209, 690
See application file for complete search history.

(56) References Cited

U.S. PATENT DOCUMENTS 5,640,174 A * 6/1997 Kamei et al. ..... 345/89
5,751,267 A * 5/1998 Sato et al. ..... 345/96
6,384,806 B1 * 5/2002 Matsueda et al. ..... 345/89
6,570,549 B2 * 5/2003 Nakanishi et al. ..... 345/87
7,002,543 B2 * 2/2006 Miyajima et al. ..... 345/94
7,023,458 B2 * 4/2006 Kudo et al. ..... 345/690
7,079,129 B2 * 7/2006 Shigeta ..... 345/213
7,193,637 B2 * 3/2007 Kudo et al. ..... 345/690
2003/0011553 A1 * 1/2003 Ozaki ..... 345/89
2004/0066363 A1 * 4/2004 Yamano et al. ..... 345/98
2004/0164943 A1 * 8/2004 Ogawa et al. ..... 345/92
2006/0033695 A1 * 2/2006 Kudo et al. ..... 345/89
2006/0164687 A1 * 7/2006 Huang et al. ..... 358/3.01
2007/0002188 A1 * 1/2007 Kumagai et al. ..... 348/751

* cited by examiner

*Primary Examiner*—Sumati Lefkowitz
*Assistant Examiner*—Rodney Amadiz
(74) *Attorney, Agent, or Firm*—Antonelli, Terry, Stout & Kraus, LLP.

(57) ABSTRACT

A liquid crystal display device includes a pixel electrode to which a video signal is supplied and a counter electrode to which a reference signal is supplied in each pixel. In the display device a positive-side gray scale voltage and a negative-side gray scale voltage are formed. The positive-side gray scale voltage and the negative-side gray scale voltage are formed with respect to the reference signal such that an average value of the positive-side gray scale voltage and the negative-side gray scale voltage is increased along with an increase of the signal amplitude of the video signal in the vicinity of the minimum thereof, the average value is decreased along with the further increase of the signal amplitude of the video signal, and the average value is increased along with an increase of the amplitude of the video signal in the vicinity of the maximum thereof.

18 Claims, 8 Drawing Sheets

FIG. 7A
Resistance setting value (Ω)
| | |
|---|---|
| R7 | 15 |
| R6 | 1 |
| R5 | 15 |
| R4 | 1 |
| R3 | 2 |
| R2 | 8 |
| R1 | 1 |
FIG. 7B
Voltage (V)
| | |
|---|---|
| Vmax(setting value) | 5.00 |
| V0 (setting value) | 0.20 |
| V8 | 5.00 |
| V7 | 3.33 |
| V6 | 3.21 |
| V5 | 1.54 |
| V4 | 1.42 |
| V3 | 1.20 |
| V2 | 0.31 |
| V1 | 0.20 |
FIG. 7C
Voltage ov CV (V)
| | |
|---|---|
| CV1 | 1.48 |
| CV2 | 2.21 |
| CV3 | 1.81 |
| CV4 | 2.60 |
FIG. 8A
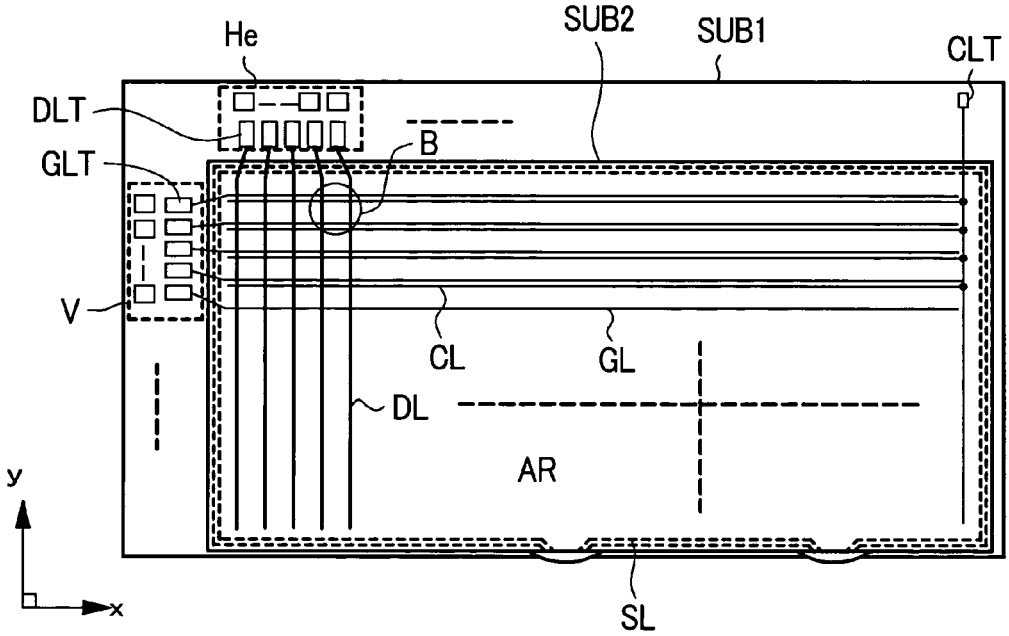
FIG. 8B
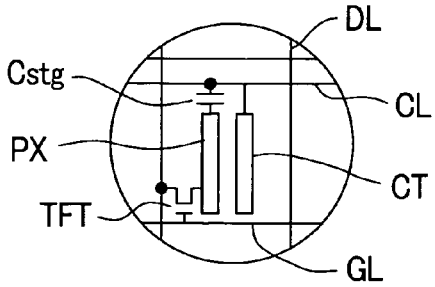

LIQUID CRYSTAL DISPLAY DEVICE WITH CONTROLLED POSITIVE AND NEGATIVE GRAY SCALE VOLTAGES

BACKGROUND OF THE INVENTION

The present invention relates to a display device, and, more particularly, to an active-matrix type liquid crystal display device when exhibits an enhanced response speed.

In an active-matrix type liquid crystal display device, on a liquid-crystal-side surface of one of a pair of substrates which face each other in an opposed manner with liquid crystal material disposed therebetween, for example, there are gate signal lines which extend in the x direction and are arranged in parallel in the y direction, and drain signal lines which extend in the y direction and are arranged in parallel in the x direction. Regions which are defined by these respective signal lines constitute pixel regions, and a plurality of these respective pixel regions are arranged in a matrix array to form a liquid crystal display part.

Here, each pixel region includes a switching element which is driven in response to a scanning signal received from one gate signal line and a pixel electrode to which a video signal is supplied from one drain signal line through the switching element. An electric field is generated between the pixel electrode and a counter electrode, which is formed on the above-mentioned one substrate or the other substrate, and the optical transmissivity of the liquid crystal is controlled based on the electric field.

The optical transmissivity of the liquid crystal is determined based on the amount of potential difference (gray scale) of the video signal (voltage) applied to the pixel electrode with respect to the reference signal (voltage) applied to a counter electrode. Here, for example, for preventing a polarization of the liquid crystal, there is a known method in which a positive-side gray scale voltage are generated and a negative-side gray scale voltage with respect to the above-mentioned video signal, and these gray scale voltages are applied alternately, for example.

In such pixel driving, while there is a known method in which the center voltage of the video signal is always fixed irrespective of the amplitude of the signal, as shown in FIG. 12A, there is also a known method in which the center voltage of the video signal is decreased corresponding to an increase in the amplitude of the signal, as shown in FIG. 12B. That is, the pixel is configured to be driven by forming the respective gray scale voltages such that an average value of the positive-side gray scale voltage and the negative-side gray scale voltage is increased with respect to the reference signal supplied to the counter electrode along with a decrease in the signal amplitude of the video signal (see Japanese Unexamined Patent Publication Hei 7(1995)-92937 (patent literature 1)).

BRIEF SUMMARY OF THE INVENTION

However, in a liquid crystal display device having such a constitution, when the signal amplitude of the video signal is switched between maximum and minimum values, to be more specific, when the display is switched from black to white or from white to black, as can be readily understood from FIG. 12B, a large difference arises between the center voltage before switching and the center voltage after switching. This implies that, when an observation is made in view of the state after switching, the state is equivalent to a state in which a DC current is applied between the pixel electrode of the pixel and the counter electrode until a point in time immediately before switching.

After switching, a center voltage suitable as a value after switching is applied by a switching element; and, hence, there exists no DC current between the pixel electrode of the pixel and the counter electrode. However, the response of the liquid crystal molecules in response to the change in voltage requires several tens of ms; and, hence, the above-mentioned influence of the DC current remains optically until the completion of the response. Accordingly, there arises a phenomenon in which the apparent response speed is delayed due to the influence of the DC voltage.

The present invention has been made under such circumstances, and it is an object of the present invention to provide a display device which has an enhanced response speed.

Typical examples of the invention disclosed in this specification are as follows.

EXAMPLE 1

A display device according to the present invention includes a pixel electrode to which a video signal is supplied and a counter electrode to which a reference signal which becomes a reference with respect to the video signal, is supplied in each pixel, wherein a positive-side gray scale voltage and a negative-side gray scale voltage are formed with respect to the reference signal applied to the counter electrode such that (a) the average value of the positive-side gray scale voltage and the negative-side gray scale voltage is increased when the signal amplitude of the video signal falls in a range from a minimum value to a first value, (b) the average value of the positive-side gray scale voltage and the negative-side gray scale voltage is decreased when the signal amplitude of the video signal falls in a range from the first value to a second value, and (c) the average value of the positive-side gray scale voltage and the negative-side gray scale voltage is increased when the signal amplitude of the video signal falls in a range from the second value to a maximum value.

EXAMPLE 2

The display device according to the present invention is, on the premise of the constitution of Example 1, characterized in that the average value of the positive-side gray scale voltage and the negative-side gray scale voltage with respect to the signal amplitude of the video signal assumes an upper extreme point at a point where the average value changes from increasing values to decreasing values, and assumes a lower extreme point at a point where the average value changes from decreasing values to increasing values in the range from the minimum value to the maximum value of the signal amplitude of the video signal.

EXAMPLE 3

The display device according to the present invention is, on the premise of the constitution of means 2, characterized in that the average value of the positive-side gray scale voltage and the negative-side gray scale voltage with respect to the signal amplitude of the video signal which reaches the lower extreme point from the upper extreme point is changed monotonously.

EXAMPLE 4

The display device according to the present invention is, on the premise of the constitution of Example 2, characterized in that the average value of the positive-side gray scale voltage and the negative-side gray scale voltage with respect to the signal amplitude of the video signal is changed monotonously from the minimum value to the upper extreme point of the signal amplitude of the video signal and from the lower extreme point to the maximum value of the signal amplitude of the video signal.

EXAMPLE 5

The display device according to the present invention is, on the premise of the constitution of Example 4, characterized in that the average value of the positive-side gray scale voltage and the negative-side gray scale voltage of the signal amplitude of the video signal at the minimum signal amplitude of the video signal is smaller than the average value of the positive-side gray scale voltage and the negative-side gray scale voltage of the signal amplitude of the video signal at the lower extreme point.

EXAMPLE 6

The display device according to the present invention is, on the premise of the constitution of Example 4, characterized in that the average value of the positive-side gray scale voltage and the negative-side gray scale voltage of the signal amplitude of the video signal at the maximum signal amplitude of the video signal is larger than the average value of the positive-side gray scale voltage and the negative-side gray scale voltage of the signal amplitude of the video signal at the upper extreme point.

EXAMPLE 7

A display device according to the present invention, includes a pixel electrode to which a video signal is supplied and a counter electrode to which a reference signal which becomes a reference with respect to the video signal is supplied in each pixel, wherein a positive-side gray scale voltage and a negative-side gray scale voltage are formed with respect to the reference signal applied to the counter electrode such that (a) the average value of the positive-side gray scale voltage and the negative-side gray scale voltage is increased when the display gray scale of the video signal falls in a range from a minimum value to a first value, (b) the average value of the positive-side gray scale voltage and the negative-side gray scale voltage is decreased when the signal amplitude of the video signal falls in a range from the first value to a second value, and (c) the average value of the positive-side gray scale voltage and the negative-side gray scale voltage is increased when the display gray scale of the video signal falls in a range from the second value to a maximum value.

EXAMPLE 8

The display device according to the present invention is, on the premise of the constitution of Example 7, characterized in that the average value of the positive-side gray scale voltage and the negative-side gray scale voltage with respect to the signal amplitude of the video signal assumes an upper extreme point at a point where the average value changes from increasing values to decreasing values and a lower extreme point at a point where the average value changes from decreasing values to increasing values in the range from the minimum value to the maximum value of the display gray scale of the video signal.

EXAMPLE 9

The display device according to the present invention is, on the premise of the constitution of Example 8, characterized in that the average value of the positive-side gray scale voltage and the negative-side gray scale voltage with respect to the signal amplitude of the video signal which reaches the lower extreme point from the upper extreme point is changed monotonously.

EXAMPLE 10

The display device according to the present invention is, on the premise of the constitution of Example 9, characterized in that the average value of the positive-side gray scale voltage and the negative-side gray scale voltage of the signal amplitude of the video signal at the minimum display gray scale of the video signal is smaller than the average value of the positive-side gray scale voltage and the negative-side gray scale voltage of the signal amplitude of the video signal at the lower extreme point.

EXAMPLE 11

The display device according to the present invention is, on the premise of the constitution of Example 9, characterized in that the average value of the positive-side gray scale voltage and the negative-side gray scale voltage of the signal amplitude of the video signal at the maximum display gray scale of the video signal is larger than the average value of the positive-side gray scale voltage and the negative-side gray scale voltage of the signal amplitude of the video signal at the upper extreme point.

EXAMPLE 12

The display device according to the present invention is, on the premise of the constitution of Example 11, characterized in that the display device is driven in a normally white mode in which the minimum level of the display gray scale assumes a white display and the maximum level of the display gray scale assumes a black display.

EXAMPLE 13

The display device according to the present invention is, on the premise of the constitution of Example 11, characterized in that the display device is driven in a normally black mode in which the minimum level of the display gray scale assumes a black display and the maximum level of the display gray scale assumes a white display.

EXAMPLE 14

A display device according to the present invention, includes a pixel electrode to which a video signal is supplied and a counter electrode to which a reference signal, which becomes a reference with respect to the video signal, is supplied in each pixel, wherein with respect to the reference signal which is applied to the counter electrode, along with an increase in the amplitude of the video signal voltage, a positive-polarity voltage characteristic of the video signal includes at least two points of inflection, such that the positive-polarity voltage is sharply increased, is gradually increased and is again sharply increased, and a negative-polarity voltage characteristic of the video signal includes at least two points of inflection, such that the negative-polarity voltage is gently decreased, is sharply decreased and is again gently decreased.

EXAMPLE 15

A display device according to the present invention, includes a pixel electrode to which a video signal is supplied and a counter electrode to which a reference signal, which becomes the reference with respect to the video signal, is supplied in each pixel, wherein along with an increase in the gray scale to be displayed, a positive-polarity voltage characteristic of the video signal includes at least two points of inflection, such that the positive-polarity voltage is sharply increased, is gradually increased and is again sharply increased, and a negative-polarity voltage characteristic of the video signal includes at least two points of inflection, such that the negative-polarity voltage is gently decreased, is sharply decreased and is again gently decreased.

EXAMPLE 16

The display device according to the present invention is, on the premise of the constitution of either one of Examples 1 or 7, characterized in that a circuit which forms the respective gray scale voltages includes gray scale division resistances and these resistances are constituted of seven or more resistances.

EXAMPLE 17

The display device according to the present invention is, on the premise of the constitution of Example 16, characterized in that a resultant resistance of the gray scale voltages between positive-polarity voltage outputs is set to be larger than a resultant resistance of the gray scale voltages between negative-polarity voltage outputs.

EXAMPLE 18

A method of driving a display device according to the present invention, for example, which includes a pixel electrode to which a video signal is supplied and a counter electrode to which a reference signal, which becomes a reference with respect to the video signal is supplied, in each pixel, wherein a positive-side gray scale voltage and a negative-side gray scale voltage are formed with respect to the reference signal applied to the counter electrode such that (a) the average value of the positive-side gray scale voltage and the negative-side gray scale voltage is increased when a signal amplitude of the video signal falls in a range from a minimum value to a first value, (b) the average value of the positive-side gray scale voltage and the negative-side gray scale voltage is decreased when the signal amplitude of the video signal falls in a range from the first value to a second value, and (c) the average value of the positive-side gray scale voltage and the negative-side gray scale voltage is increased when the signal amplitude of the video signal falls in a range from the second value to a maximum value.

The present invention is not limited to the above-mentioned constitutions and various modifications are conceivable without departing from the technical concept of the present invention.

BRIEF DESCRIPTION OF THE DRAWINGS

FIGS. 7A to 7C are tables is a table showing one embodiment of respective resistance values of the resistance divider circuit in the latter stage of the gray scale generating circuit provided to the display device according to the present invention, gray scale voltages obtained from the resistance voltage divider circuit and the center voltage of the video signal, respectively;

FIG. 8A is an equivalent circuit diagram showing one embodiment of the display device according to the present invention, and FIG. 8B is a circuit diagram of a representative pixel region B in FIG. 8A;

DETAILED DESCRIPTION OF THE INVENTION

Figure 1:
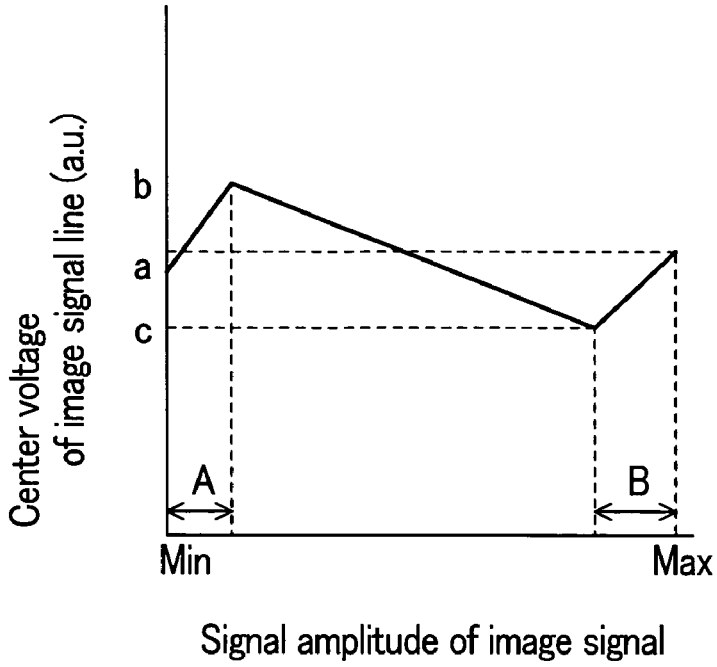
FIG. 1 is a characteristic diagram showing the relationship between the signal amplitude of a video signal and a center voltage (an average value of a positive-side gray scale voltage and a negative-side gray scale voltage) of the video signal of a display device according to one embodiment of the present invention.

Embodiments of a display device according to the present invention will be explained in conjunction with the drawings hereinafter.

Embodiment 1

<<Overall Equivalent Circuit>>

FIG. 8A is an equivalent circuit diagram showing one embodiment of a display device (a liquid crystal display device in this embodiment) according to the present invention. Although the drawing is an equivalent circuit diagram, it is depicted in accordance with the actual arrangement of the circuit elements of the display device.

The display device includes a pair of transparent substrates SUB1, SUB2 which are arranged to face each other in an opposed manner with liquid crystal material disposed therebetween, wherein the liquid crystal is disposed in a space that is sealed by a sealing material SL, which also performs the function of fixing the transparent substrate SUB2 to the transparent substrate SUB1.

On a liquid-crystal-side surface of the transparent substrate SUB1, in an area which is surrounded by the sealing material SL, gate signal lines GL extend in the x direction and are arranged in parallel in the y direction, and drain signal lines DL extend in the y direction and are arranged in parallel in the x direction.

Regions which are bounded by the respective gate signal lines GL and the respective drain signal lines DL constitute pixel regions, and a plurality of these respective pixel regions are disposed in a matrix array so as to constitute a liquid crystal display part AR.

Further, in the respective pixel regions which are arranged in parallel in the x direction, a common counter voltage signal line CL, which runs in the inside of the respective pixel regions, is formed. The counter voltage signal line CL constitutes a signal line for supplying a voltage, which becomes a reference with respect to a video signal, to a counter electrode CT of the pixel region.

In each pixel region, there are a thin film transistor TFT, which is driven in response to a scanning signal from the one-side gate signal line GL, and a pixel electrode PX to which a video signal is supplied from the one-side drain signal line DL via this thin film transistor TFT. An electric field is generated between this pixel electrode PX and a counter electrode CT which is connected to the counter voltage signal line CL, and the optical transmissivity of the liquid crystal is controlled in response to the electric field.

Here, a capacitive element Cstg is formed between the pixel electrode PX and the counter voltage signal line CL, and a video signal which is supplied to the pixel electrode PX is held for a relatively long time due to this capacitive element Cstg.

Respective ends of the above-mentioned gate signal lines GL extend beyond the above-mentioned sealing material SL, and the extended ends thereof form terminals GLT to which output terminals of the scanning signal drive circuit V are connected. Further, to input terminal of the scanning signal drive circuit V, a signal from a printed circuit board (not shown in the drawing) which is arranged outside the liquid crystal display panel is inputted. The scanning signal drive circuit V is formed of a plurality of semiconductor devices. A plurality of gate signal lines GL which are arranged close to each other are formed into a group, and one semiconductor device is allocated to each group of gate signal lines GL.

In the same manner, respective ends of the drain signal line DL extend beyond the sealing material SL, and the extended ends constitute terminals DLT to which output terminals of the video signal drive circuit He are connected. Further, to input terminals of the video signal drive circuit He, a signal from a printed circuit board (not shown in the drawing) which is arranged outside the liquid crystal display panel is inputted.

The video signal drive circuit He is also formed of a plurality of semiconductor devices. A plurality of drain signal lines DL which are arranged close to each other are formed into a group, and one semiconductor device is allocated to each group of drain signal lines DL. Further, the counter voltage signal lines CL are connected in common to a connection line at the right side as seen in the drawing, and the connection line extends beyond the sealing material SL and constitutes a terminal CLT at an extended end thereof. From the terminal CLT, a voltage which becomes a reference with respect to the video signal is supplied to the pixels.

The respective gate signal lines GL are selected sequentially one after another in response to the scanning signal from the scanning signal drive circuit V. Further, to respective drain signal lines DL, the video signal is supplied from the video signal drive circuit He at the timing of selecting the gate signal lines GL.

In the above-mentioned embodiment, the scanning signal drive circuit V and the video signal drive circuit He are constituted of semiconductor devices which are mounted on the transparent substrate SUB1. However, the scanning signal drive circuit V and the video signal drive circuit He may be formed of semiconductor devices by a so-called tape carrier method, in which the devices are connected to each other while bridging over the transparent substrate SUB1 and a printed circuit board, for example. Alternatively, when a semiconductor layer of the thin film transistor TFT is formed of a polycrystalline silicon (p-Si), semiconductor elements made of polycrystalline silicon may be formed on a surface of the transparent substrate SUB1 together with the wiring layers.

<<Constitution of Pixel>>

Figure 9A:
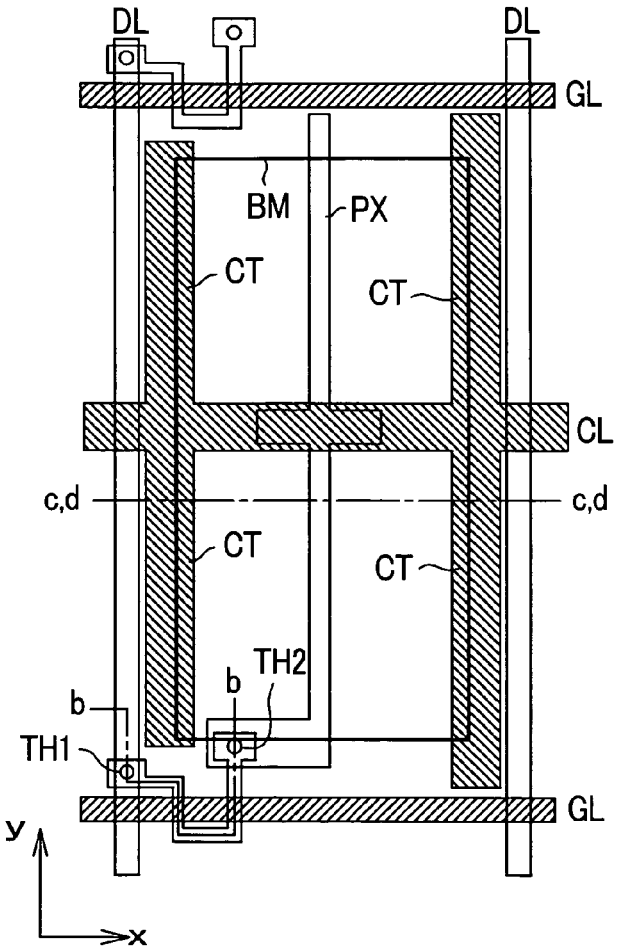
FIG. 9A is a plan view.
Figure 9B:
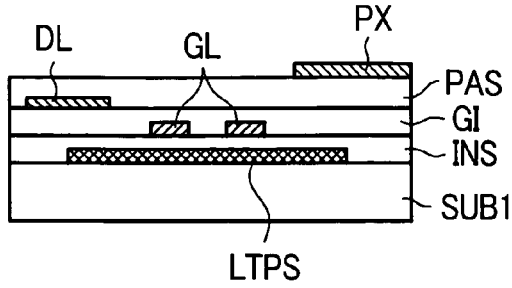
FIGS. 9B to 9D are sectional views taken along lines a-a, b-b and c-c showing one embodiment of the pixel of the display device according to the present invention.
Figure 9C:
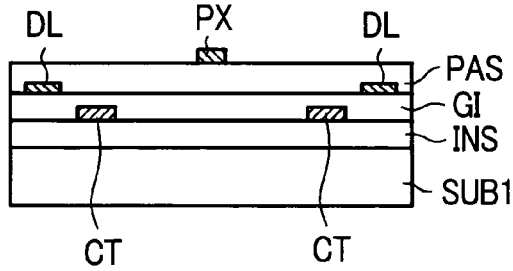
Figure 9D:
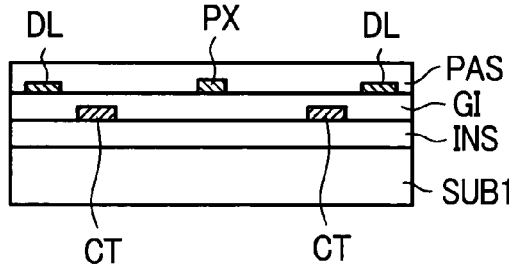

FIG. 9A is a plan view showing one embodiment of the specific constitution of the above-mentioned pixel, FIG. 9(*b*) is a cross-sectional view taken along a line b-b in FIG. 9(*a*), and FIG. 9(*c*) is a cross-sectional view taken along a line c-c in FIG. 9(*a*).

First of all, on a liquid-crystal-side surface of the transparent substrate SUB1, there is a semiconductor layer LTPS formed of a polysilicon layer, for example. The semiconductor layer LTPS is formed by polycrystalizing an amorphous Si film formed by a plasma CVD device, for example, using an excimer laser. The semiconductor layer LTPS is a semiconductor layer of the thin film transistor TFT and is formed in a roundabout manner such that the semiconductor layer LTPS traverses the gate signal line GL twice.

Further, on the surface of the transparent substrate SUB1 on which the semiconductor layers LTPS is formed, a first insulation film INS made of $SiO_2$ or SiN, for example, is formed such that the first insulation film INS also covers the semiconductor layers LTPS. The first insulation film INS is configured to function as a gate insulation film of the thin film transistor TFT.

Further, on an upper surface of the first insulation film INS, the gate signal lines GL extend in the x direction and are arranged in parallel in the y direction as seen in the drawing, and the gate signal lines GL define rectangular pixel regions together with the drain signal lines DL. The gate signal lines GL are configured to run so as to traverse the semiconductor layer LTPS twice, and portions of the gate signal lines GL which traverse the semiconductor layer LTPS function as gate electrodes of the thin film transistor TFT.

After the formation of the gate signal lines GL, impurities ions are implanted by way of the first insulation film INS so as to make the regions of the semiconductor layer LTPS, except for a region right below the gate signal line GL, conductive, thus forming a source region and a drain region of the thin film transistor TFT.

Further, on an upper surface of the first insulation film INS, counter electrodes CT are formed. With respect to the counter electrodes CT, for example, two strip-like electrodes which extend in the y direction as seen in the drawing are arranged close to the drain signal lines DL in the pixel. These respective counter electrodes CT are integrally formed with a counter voltage signal line CL which runs in the x direction as seen in the drawing at substantially the center of the pixel, and the reference signal is supplied through the counter voltage signal line CL.

Further, on the upper surface of the above-mentioned first insulation film INS, a second insulation film GI, which is made of $SiO_2$ or SiN, for example, is formed such that the second insulation film GI also covers the gate signal lines GL and the counter electrodes CT (counter voltage signal lines CL).

On a surface of the second insulation film GI, the drain signal lines DL extend in the y direction and are arranged in parallel in the x direction. Then, portions of the drain signal lines DL are connected to the above-mentioned semiconductor layer LTPS via through holes TH1 which penetrate the second insulation film GI and the first insulation film INS disposed below the drain signal lines DL. Portions of the semiconductor layer LTPS which are connected with the drain signal lines DL are portions which constitute one region, for example, drain regions of the thin film transistor TFT.

On the surface of the second insulation film GI, a third insulation film PAS is formed such that the third insulation film PAS also covers the drain signal lines DL. On a surface of the third insulation film PAS, pixel electrodes PX are formed. These pixel electrodes PX are formed of strip-like electrodes which extend in the y direction as seen in the drawing at the center of the pixels; and, hence, the pixel electrode PX is positioned between the above-mentioned respective counter electrodes CT The pixel electrode PX has a portion thereof connected with another region, for example, a source region of the thin film transistor TFT, via a through hole TH2 which is formed in the third insulation film PAS, the second insulation film GI and the first insulation film INS disposed below the pixel electrode in a penetrating manner.

Here, the pixel electrode PX is formed to have a large width at a portion thereof which intersects the counter voltage signal line CL, and a capacitive element Cstg is formed between the pixel electrode PX and the counter voltage signal line CL at that portion.

Electric fields which have components parallel to the transparent substrate SUB1 are generated between the pixel electrode PX and the respective counter electrodes, which are respectively positioned at both sides of the pixel electrode PX, and the optical transmissivity of the liquid crystal can be controlled due to these electric fields.

Here, the pixel electrode PX, in this first embodiment, is formed of a light-transmitting conductive layer, such as ITO (Indium Tin Oxide), ITZO (Indium Tin Zinc Oxide), IZO (Indium Zinc Oxide), $SnO_2$ (Tin Oxide), $In_2O_3$ (Indium Oxide), for example, for enhancing the numerical aperture.

In the above-mentioned embodiment, the pixel electrodes PX are formed on the upper surface of the third insulation film PAS. However, it is needless to say that, as shown in FIG. 9(*d*), the pixel electrodes PX may be formed below the third insulation film PAS, that is, on the same layer as the drain signal lines DL. This is because substantially the same advantageous effects can be obtained in this way.

<<Video Signal>>

Figure 12A:
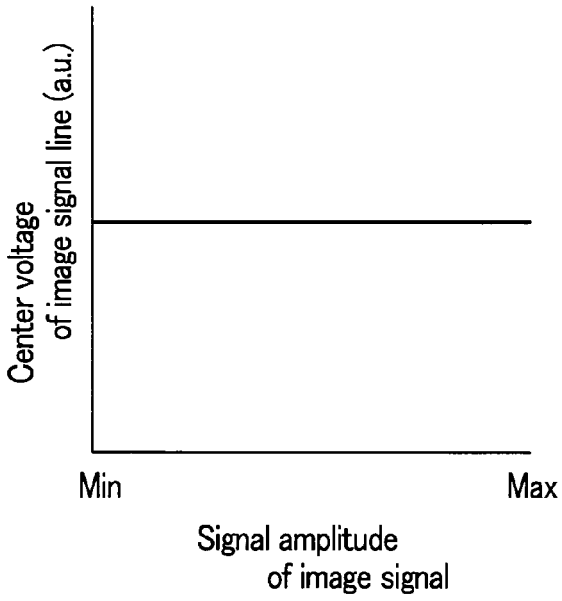
FIGS. 12A and 12B are graphs showing examples of the relationship between the signal amplitude of a video signal and the center voltage of the video signal of a conventional liquid crystal display device.
Figure 12B:
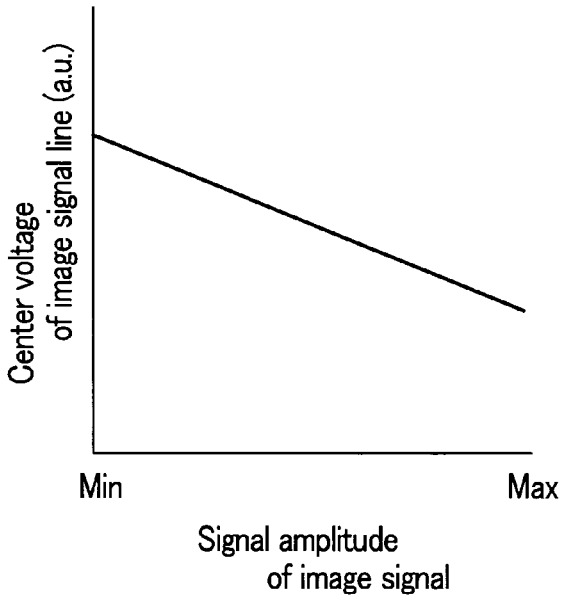

FIG. 1 is a characteristic diagram showing the center voltage which is changed in response to the magnitude of the video signal supplied to the respective drain signal lines DL of the liquid crystal display device according to the present invention, and it can be compared to FIG. 12B.

In the characteristic diagram shown in FIG. 1, the amplitude of the video signal is taken on an axis of abscissas such that the amplitude assumes a minimum value at the left side as seen in the drawing and a maximum value at the right side as seen in the drawing, and the center voltage of the video signal is taken on an axis of ordinates. Here, the center voltage of the video signal constitutes an average value of the positive-side gray scale voltage and the negative-side gray scale voltage of the video signal.

The center voltage of the video signal, first of all, assumes a certain value "a" when the amplitude of the video signal assumes the minimum value and is increased corresponding to an increase of the amplitude of the video signal to a first value, thus assuming a certain value "b". Then, the center voltage of the video signal is decreased corresponding to an increase of the amplitude of the video signal to a second value. Then, when the center voltage of the video signal arrives at a certain value "c", the center voltage of the video signal is increased to reach the certain value "a" or a value which is close to the value "a". In other words, the center voltage of the video signal at the minimum amplitude value is set to the proper center voltage at the maximum amplitude value, and the center voltage of the video signal at the maximum amplitude value is set to the proper center voltage at the minimum amplitude value.

Basically, the characteristic diagram shown in FIG. 1 can be compared to the characteristic diagram shown in FIG. 12A with respect to the point that the center voltage of the video signal is decreased corresponding to an increase of the signal amplitude of the video signal. However, the characteristic graph of FIG. 1 differs from the characteristic diagram shown in FIG. 12A with respect to the point that the center voltage of the video signal is increased within a fixed range A starting from a point of time when the signal amplitude of the video signal assumes the minimum value (a range from the minimum value to the first value) and within a fixed range B from a point of time immediately before a point of time in which the signal amplitude assumes the maximum value to the point of time in which the signal amplitude assumes the maximum value (a range from the second value to the maximum value).

The reason why the above-mentioned characteristic is adopted is as follows. As shown in FIG. 12A, when the center voltage of the video signal is increased as it is with respect to the reference signal applied to the counter electrode corresponding to a decrease of the signal amplitude of the video signal, the difference between the center voltage of the video signal at the minimum amplitude and the center voltage of the video signal at the maximum amplitude becomes relatively large. The characteristic shown in FIG. 1 is adopted to decrease this difference. By decreasing this difference, it is possible to enhance the response speed at the time of switching from white to black and black to white, which is most important in the response time of the liquid crystal display device.

In this case, the reduction of image retention, which is an advantageous effect of the characteristic shown in FIG. 12B, with respect to the characteristic shown in FIG. 12A can be also maintained in this embodiment. This is because, with respect to the characteristic of the video signal shown in FIG. 12B, there arises a phenomenon in which the image retention is hardly observed in the vicinity of white and black, excluding the colors of intermediate tones.

Figure 2:
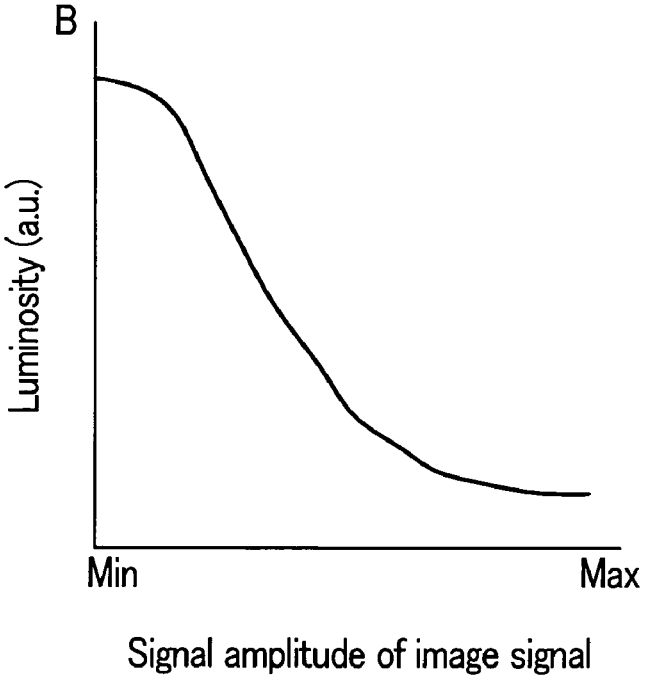
FIG. 2 is a graph showing the relationship between the signal amplitude of the video signal and the display brightness of the display device according to the present invention.

That is, FIG. 2 shows a B (brightness)-V (voltage) curve of the liquid crystal in use. Although the change in brightness in response to a change of the voltage is sensitive in portions, except for portions where the amplitude of the video signal assumes the minimum value and the maximum value, the change in brightness becomes relatively insensitive to a change of voltage in the vicinity of the portions where the amplitude of the video signal assumes the minimum value and the maximum value.

In view of the above, the image retention is hardly recognized in the vicinity of the portions where the amplitude of the video signal assumes the minimum value and the maximum value (in other words, in the range from the minimum value to the first value and in the range from the second value to the maximum value).

FIG. 2 is a graph in which the amplitude of the video signal is taken on an axis of abscissas and the brightness is taken on an axis of ordinates, wherein the liquid crystal in use is liquid crystal for a so-called normally white mode in which a white display is produced in a state in which a voltage is not applied to the liquid crystal. However, with respect to the phenomenon in which the image retention is hardly observed in the vicinity of white and black, except for the colors of intermediate tones, the circumstances are exactly the same also with respect to a so-called normally black mode.

Figure 3:
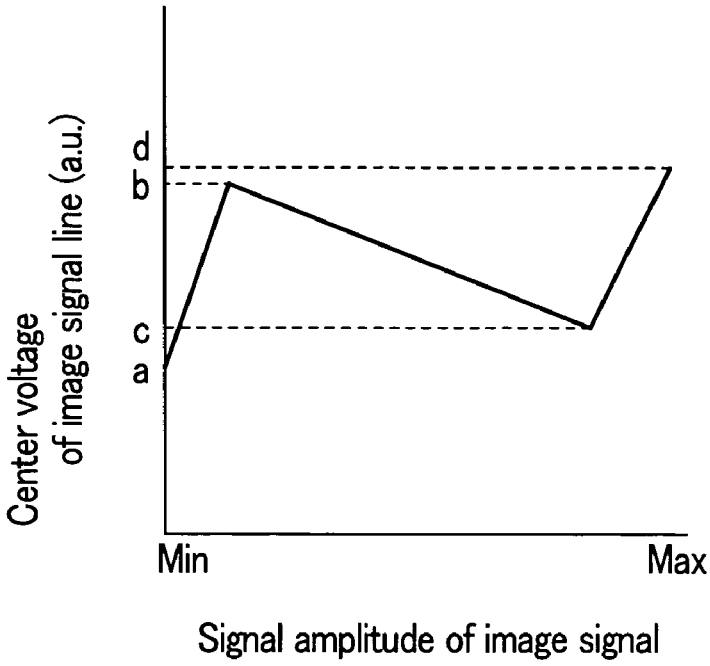
FIG. 3 is a characteristic diagram showing the relationship between the signal amplitude of the video signal and the center voltage (the average value of the positive-side gray scale voltage and the negative-side gray scale voltage) of the video signal of a display device according to another embodiment of the present invention.

FIG. 3 is a characteristic diagram showing another embodiment in which the center voltage is changed in response to the magnitude of the video signal supplied to the respective drain signal lines DL of the liquid crystal display device according to the present invention and it can be compared to FIG. 1.

A point which makes this characteristic different from the characteristic shown in FIG. 1 lies in the fact that an average value "a" of the positive-side gray scale voltage and the negative-side gray scale voltage of the video signal at the minimum signal amplitude of the video signal is set to be smaller than a value "c" of a starting point of the increase of the average value of the positive-side gray scale voltage and the negative-side gray scale voltage of the video signal in the vicinity of the maximum signal amplitude of the video signal.

Further, another point which makes this characteristic different from the characteristic shown in FIG. 1 lies in the fact that an average value "d" of the positive-side gray scale voltage and the negative-side gray scale voltage of the video signal at the maximum signal amplitude of the video signal is set to be larger than a value "b" of an arrival point of the increase of the average value of the positive-side gray scale voltage and the negative-side gray scale voltage of the video signal in the vicinity of the minimum signal amplitude of the video signal.

Due to such a constitution, compared to the characteristics of the video signal shown in FIG. 1, the superposition of DC voltages after switching of white and black can be reduced more effectively, and, hence, it is possible to achieve the advantageous effect that the response speed can be enhanced.

Here, in the above-mentioned graphs shown in FIG. 1 and FIG. 3, the signal amplitude of the video signal is taken on the axis of abscissas. However, it is possible to obtain an substantially the same advantageous effects even when the signal amplitude is replaced with the display gray scale.

<<Relationship Among Video Signal, Reference Signal and Gate Signal>>

Figure 4:
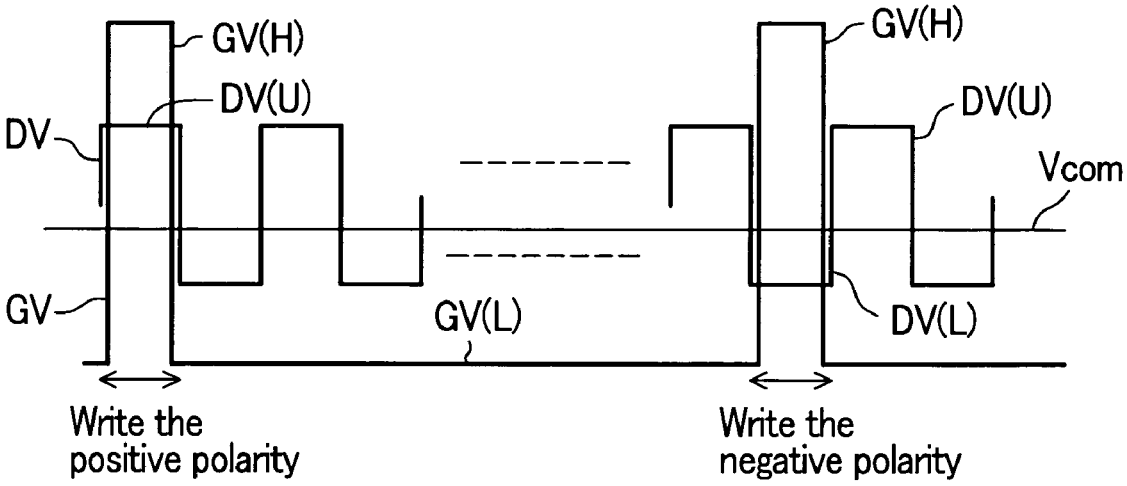
FIG. 4 is a timing chart showing the video signal (having the positive-side gray scale voltage and the negative-side gray scale voltage), a scanning signal and a reference signal supplied to pixels of the display device according to the present invention.

FIG. 4 is a timing chart showing the video signal, the reference signal and the scanning signal supplied to the pixels. In FIG. 4, time is taken on an axis of abscissas and a potential is taken on an axis of ordinates.

First of all, the gate signal GV is supplied to the first-line gate signal line GL, for example. In this case, the gate signal GV has a gate ON voltage GV (H) and a gate OFF voltage GV (L), and the first-line gate signal line GL is selected in response to a pulse of the gate ON voltage GV (H). Due to such a selection, the thin film transistors TFT, which adopt the first-line gate signal line GL as the gate electrodes, assume the ON state; and, hence, the pixels which include the thin film transistors TFT in the ON state, that is, the respective pixels of the row of the first-line pixels which are arranged close to the given gate signal line GL and are arranged along the longitudinal direction of the given gate signal line GL, assume a state in which the pixels receive the video signal DV via the corresponding drain signal line DL.

The supply of the video signal DV to the respective pixels of the pixel row is outputted in conformity with the selection timing of the gate signal line GL. In this case, the video signal DV has the positive-side gray scale voltage (positive-polarity voltage) DV (U) and is supplied to the pixel electrode PX of the pixel by way of the thin film transistor TFT. Here, the positive-side gray scale voltage (positive-polarity voltage) DV (U) implies that the pixel electrode PX assumes the positive-polarity voltage with respect to the reference signal Vcom which is supplied to the counter electrode CT of each pixel.

Then, in the next operation, an other gate signal line GL, which is different from the above-mentioned given gate signal line GL, for example, the second-line gate signal line GL, which is arranged close to the above-mentioned given gate signal line GL is selected, and the video signal DV is supplied to the respective pixels of the second-line pixel row which is arranged along the selected gate signal line GL. This video signal DV has the negative-side gray scale voltage (negative-polarity voltage) DV (L). The negative-side gray scale voltage (negative-polarity voltage) DV (L) assumes the negative-polarity voltage with respect to the reference signal Vcom supplied to the counter electrodes CT of the respective pixels. That is, the video signal DV is supplied sequentially in conformity with the timing for supplying the scanning signal GV to the gate signal lines GL which are sequentially selected, wherein the polarity of the video signal DL is inverted for every supply.

After the respective gate signal lines GL in one frame are all selected in this manner, the gate signal lines GL are sequentially selected in substantially the same manner in the next frame. In this case, at a point of time at which the above-mentioned first-line gate signal line GL is selected, the video signal DV which is supplied to the respective pixels of the first-line pixel row arranged along the gate signal line GL has the negative-side gray scale voltage (negative-polarity voltage) DV (L).

<<Gray Scale Voltage>>

The video signal DV is outputted in conformity with the timing of the sequential supplying of the scanning signal, for example, such that the positive-side gray scale voltage (positive-polarity voltage) DV (U) and the negative-side gray scale voltage (negative-polarity voltage) DV (L) are alternately repeated. However, the video signal DV is shown in FIG. 4 such that, for the sake of brevity of explanation, the voltage value of the positive-side gray scale voltage (positive-polarity voltage) DV (U) and the voltage value of the negative-side gray scale voltage (negative-polarity voltage) DV (L) are fixed.

However, provided that these gray scale voltages are formed of a gray scale voltage, these gray scale voltages are applied to the pixel electrodes PX having voltage values corresponding to the display colors of the pixels.

Figure 5:
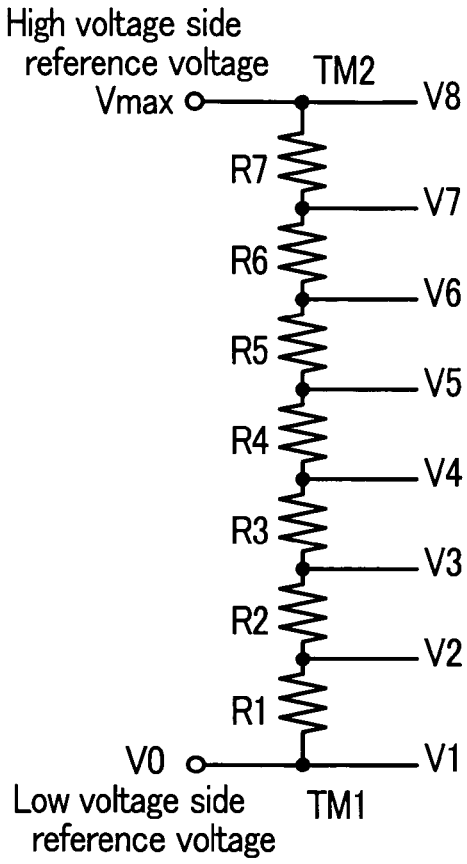
FIG. 5 is a circuit diagram showing one embodiment of a resistance voltage divider circuit provided to a latter stage of a gray scale generating circuit provided in the display device according to the present invention.

FIG. 5 shows a resistance voltage divider circuit which is provided at a final stage of a gray scale generating circuit incorporated in the above-mentioned video signal drive circuit He. In the drawing, between a terminal TM1 to which a low-voltage-side reference voltage V0 is supplied and a terminal TM2 to which a high-voltage-side reference voltage Vmax is supplied, for example, seven resistances R1, R2, R3, . . . , R6, R7 are connected in series from the above-mentioned terminal TM1 side.

Then, voltages respectively having divided voltage values are supplied from connection points of the respective resistances, including the above-mentioned respective terminals TM1, TM2. That is, the voltage V1 is supplied from the terminal TM1, the voltage V2 is supplied from the connection point of the resistance R1 and the resistance R2, the voltage V3 is supplied from the connection point of the resistance R2 and the resistance R3, . . . , the voltage V7 is supplied from the connection point of the resistance R6 and the resistance R7, and the voltage V8 is supplied from the terminal TM2.

Among these voltages, the voltages V1 to V4 are taken out as the negative-side gray scale voltages (negative-polarity voltages) DV(L) and the voltages V5 to V8 are taken out as the positive-side gray scale voltages (positive-polarity voltages) DV(U).

With respect to these gray scale voltages, in response to gray scale data for making given pixels produce a display among image data inputted to the liquid crystal display device, any one of the voltages V5 to V8 is selected when the gray scale voltage is inverted to the positive side and one of the voltages V1 to V4 is selected when the gray scale voltage is inverted to the negative side and, thereafter, is supplied to the drain signal line DL.

Here, although the resistance voltage divider circuit shown in FIG. 5 uses seven resistances, for example, the number of resistances is not limited. That is, the respective outputs may be further divided using resistances to obtain a finer division of the gray scales, and it is needless to say that the resistance voltage divider circuit can have such a constitution.

<<Relationship Between Center Voltage and Display Gray Scales of Video Signal>>

Figure 6:
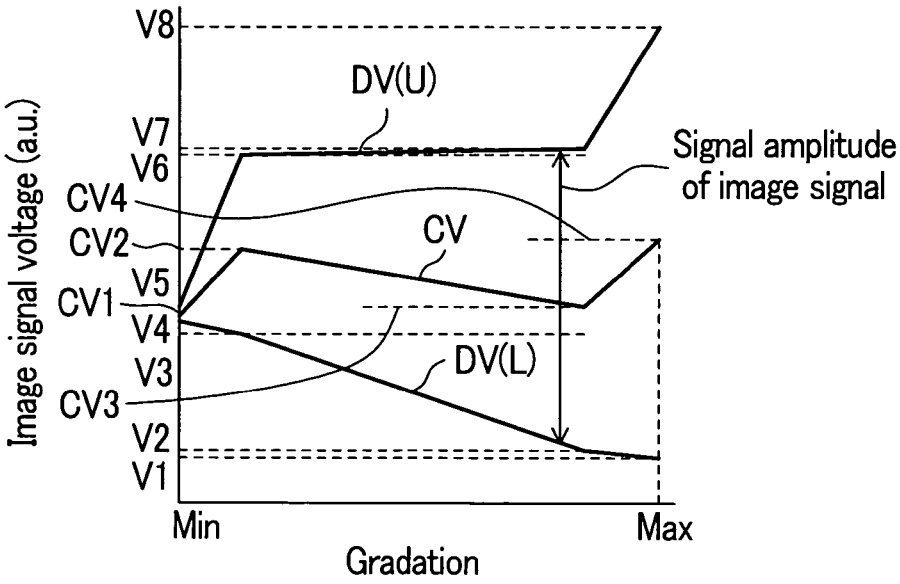
FIG. 6 is a graph showing one embodiment of a video signal (having a positive-side gray scale voltage and a negative-side gray scale voltage) supplied to pixels of the display device according to the present invention in view of the relationship thereof with a display gray scale of the video signal.

FIG. 6 is a graph showing the relationship between the center voltage CV of the video signal DV and the display gray scale of the video signal DV. In FIG. 6, the display gray scale of the video signal DV is taken on an axis of abscissas in a state in which the gray scale assumes the minimum value at the left side and the maximum value at the right side, while the voltage of the video signal is taken on an axis of ordinates.

The center voltage of the video signal DV exhibits the change characteristics shown in FIG. 1, wherein the center voltage first takes the value CV1 when the display gray scale is minimum and is increased corresponding to the increase of the display gray scale to a certain extent and assumes the value CV2. Then, the center voltage of the video signal DV is decreased corresponding to a subsequent increase of the display gray scale and assumes the value CV3 immediately before the maximum display gray scale and takes the value CV4 when the display gray scale becomes maximum.

With respect to this center voltage, the positive-side gray scale voltage (positive-polarity voltage) DV(U) is set such that the positive-side gray scale voltage DV(U) is increased sequentially along with the increase of the display gray scale, wherein the positive-side gray scale voltage DV(U)sequentially assumes the values V5, V6, V7 and V8 over a range from the minimum value to the maximum value of the pixel display gray scale. Further, with respect to this center voltage, the negative-side gray scale voltage (negative-polarity voltage) DV(L) is also set such that the negative-side gray scale voltage DV(L) is increased sequentially along with the increase of the display gray scale, wherein the negative-side gray scale voltage DV(L)sequentially assumes the values V4, V3, V2 and V1 over a range from the minimum value to the maximum value of the pixel display gray scale. In view of the above, by setting the respective resistances R1, R2, R3, . . . , R6, F8 of the resistance voltage divider circuit shown in FIG. 5 to given values and by allowing the respective gray scale voltages V1, V2, V3, . . . V7, V8 obtained based on these resistances so as to have the relationship shown in FIG. 6, it is apparent that the change characteristics of the center voltage of the video signal DV is also expressed as shown in FIG. 6.

FIG. 7A shows an example in which the respective resistances of the resistance voltage divider circuit shown in FIG. 5 are set such that R1=1Ω, R2=8Ω, R3=2Ω, R4=1Ω, R5=1Ω, R6=1Ω and R7=15Ω.

FIG. 7B shows an example in which the high-voltage-side reference voltage Vmax is set to 5.00V and the low-voltage-side reference voltage V0 is set to 0.20V in the resistance voltage divider circuit shown in FIG. 5, wherein the respective voltages divided by the resistances having the above-mentioned resistance values are set such that V8=5.00V, V7=3.33V, V6=3.21V, V5=1.54V, V4=1.42V, V3=1.20V, V2=0.31V, V1=0.20V.

FIG. 7C show the center voltages that have been calculated based on the respective voltages obtained in FIG. 7B, wherein the center voltages CV are set such that CV1=1.48V, CV2=2.21V, CV3=1.81V, CV4=2.60V. Here, CV1 is the average value of the above-mentioned voltages V5 and V4, CV2 is the average value of the above-mentioned voltages V6 and V3, CV3 is the average value of the above-mentioned voltages V7 and V2, and CV4 is the average value of the above-mentioned voltages V8 and V1.

Embodiment 2

Figure 10:
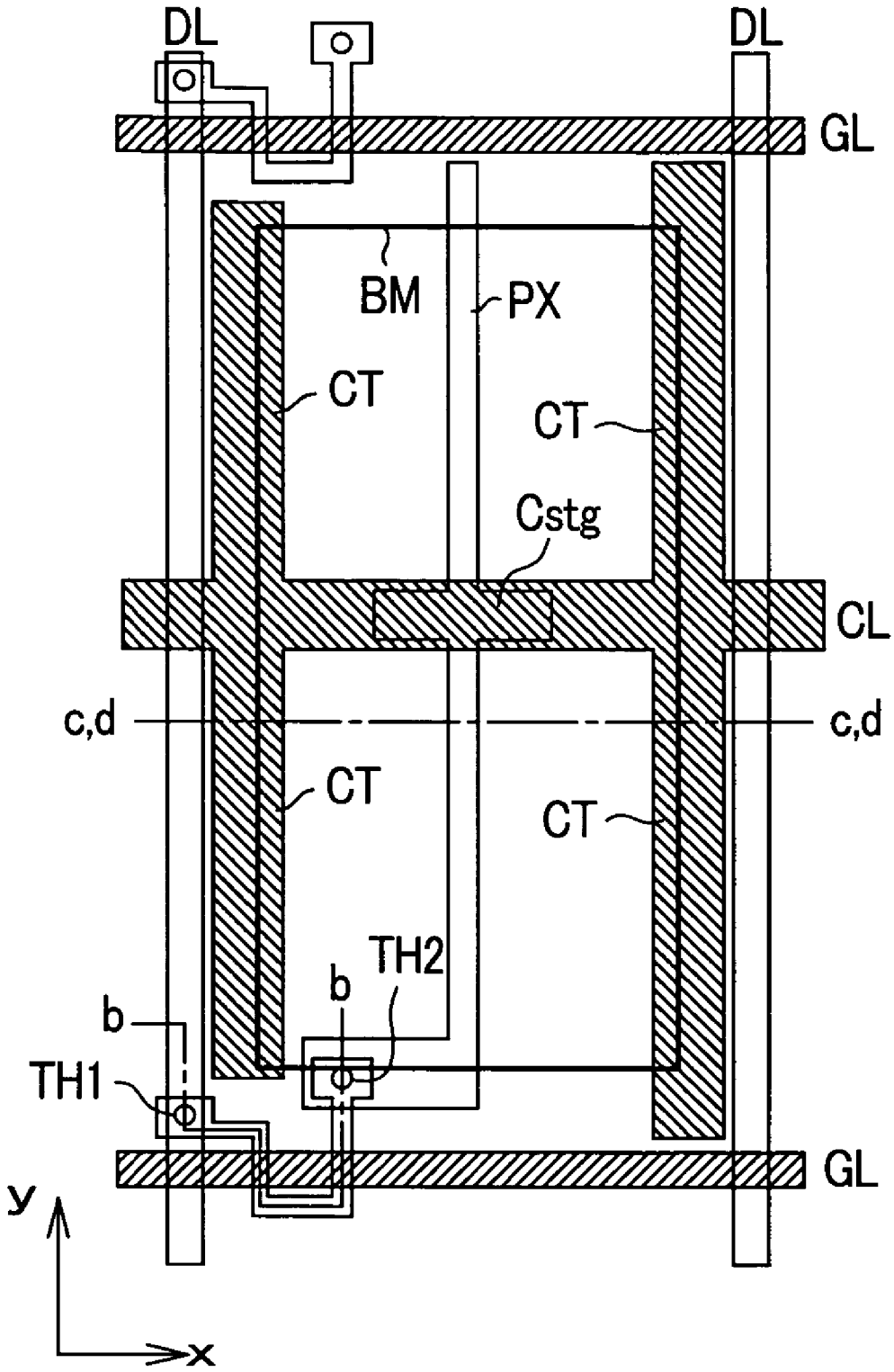
FIG. 10 is a plan view showing another embodiment of the pixel of the display device according to the present invention.

FIG. 10 is a plan view showing another embodiment of a typical pixel of the liquid crystal display device according to the present invention, and it may be compared to FIG. 9A.

The constitution which makes this embodiment different from the embodiment shown in FIG. 9A lies in the constitution of the pixel electrode PX. That is, in this embodiment, the pixel electrode PX has the end portion thereof at a side opposite to the side where the pixel electrode PX is connected to the thin film transistor TFT extended to and superposed on another gate signal line GL, which is arranged with the pixel electrode PX sandwiched between another gate signal line GL and the gate signal line GL, which drives the thin film transistor TFT, and a capacitive element Cadd is formed on the superposed portion.

Due to such a constitution, the pixel can have both the capacitive element Cstg and the capacitive element Cadd. It is needless to say that the pixel also may be configured to have only the capacitive element Cadd, without forming the capacitive element Cstg.

Embodiment 3

Figure 11:
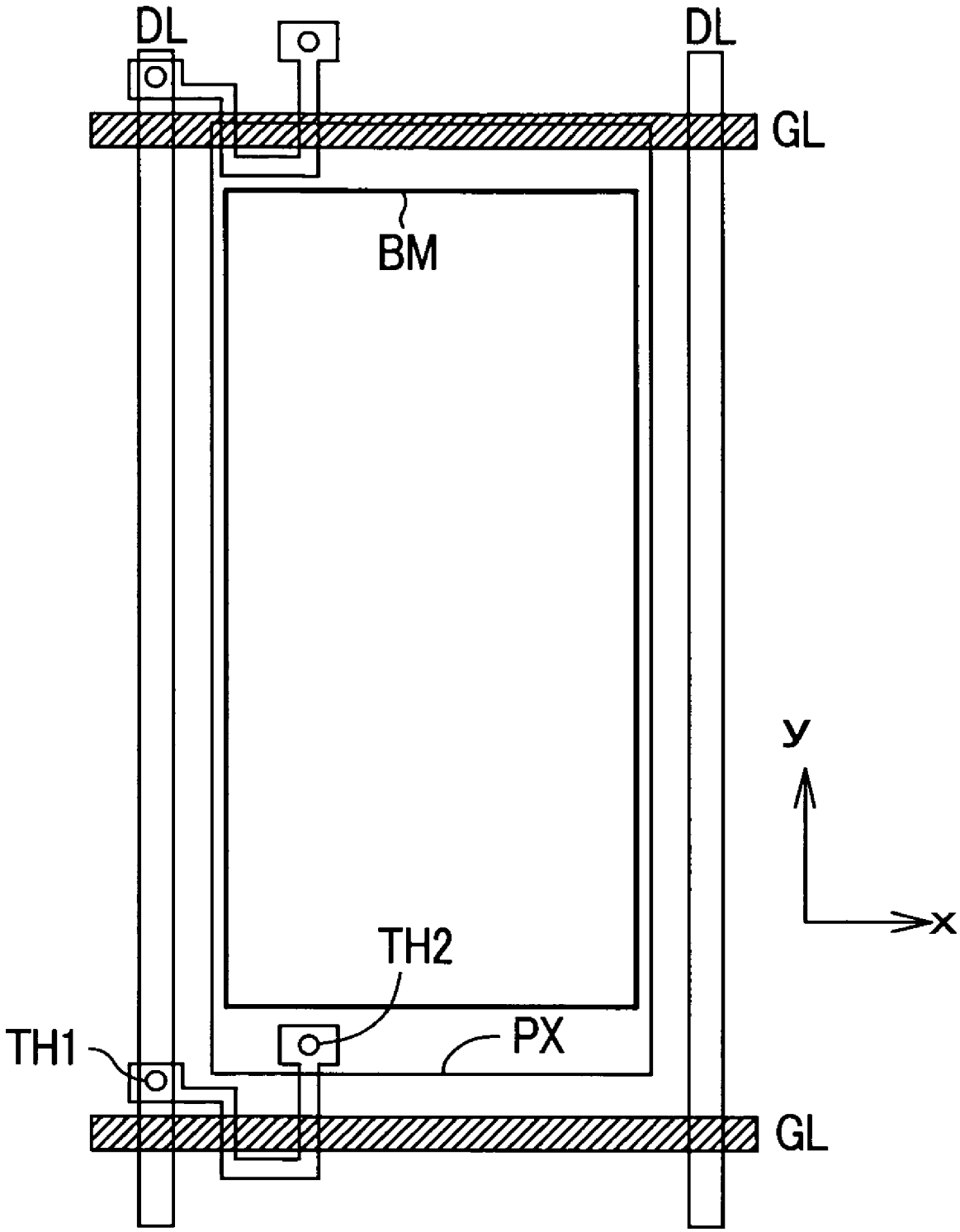
FIG. 11 is a plan view showing still another embodiment of a pixel of a liquid crystal display device according to the present invention.

FIG. 11 is a plan view showing another embodiment of a typical of the liquid crystal display device according to the present invention. In the above-mentioned embodiments, the pixel electrode PX and the counter electrode CT are formed at the transparent substrate SUB1 side, and the optical transmissivity of the liquid crystal is controlled by an electric field which is generated between these electrodes, which electric field has its main component substantially parallel to the surface of the transparent substrate SUB1.

However, with respect to the pixel shown in FIG. 11, the counter electrode CT (not shown in the drawing) is formed on a liquid-crystal-side surface of the transparent substrate SUB2, which is arranged to face the transparent substrate SUB1 in an opposed manner with the liquid crystal disposed therebetween, in common with the respective pixels, wherein the optical transmissivity of the liquid crystal is controlled by an electric field which is generated between the counter electrode CT and the pixel electrodes PX, which electric field has its main component perpendicular to the surface of the transparent substrate SUB1.

The pixel electrode PX is formed on substantially the whole area of the pixel region. By forming both the pixel electrode PX and the counter electrode CT using a transparent conductive film such as ITO or the like, it is possible to observe the optical transmissivity of the liquid crystal with the naked eye.

Here, a portion of the periphery of the pixel electrode PX is formed in a superposed manner on another gate signal line GL, which is arranged such that the pixel electrode PX is sandwiched between another gate signal line GL and the gate signal line GL which drives the thin film transistor TFT connected to the pixel electrode PX, and a capacitive element Cadd is formed at the superposed portion.

The above-mentioned embodiments may be used in a single form or in combination. This is because the advantageous effects of the respective embodiments can be obtained in a single form or synergistically.

As can be clearly understood from the foregoing explanation, according to the liquid crystal display device of the present invention, it is possible to enhance the response speed of the display device.

The invention claimed is:

1. A display device comprising:

a display area including a plurality of gate signal lines and a plurality of drain signal lines crossing the plurality of gate signal lines, and a plurality of pixel regions surrounding the plurality of gate signal lines and the plurality of drain signal lines;

a plurality of common counter voltage signal lines arranged in the respective pixel regions;

a pixel electrode and a counter electrode arranged in the respective pixel regions, and wherein the display device supplies a video signal to the pixel electrode through each of the plurality of drain signal lines and said display device supplies a reference signal, which becomes a reference with respect to the video signal, to the counter electrode through each of the plurality of common counter voltage signal lines in each pixel, and wherein the display device produces a positive-side gray scale voltage and a negative-side gray scale voltage with respect to the reference signal applied to the counter electrode, and wherein the display device controls the average value of the positive-side gray scale voltage and the negative-side gray scale voltage such that:

(a) the average value of the positive-side gray scale voltage and the negative-side gray scale voltage is increased when a signal amplitude of the video signal falls in a range from a minimum value to a first value, (b) the average value of the positive-side gray scale voltage and the negative-side gray scale voltage is decreased when the signal amplitude of the video signal falls in a range from the first value to a second value, and (c) the average value of the positive-side gray scale voltage and the negative-side gray scale voltage is increased when the signal amplitude of the video signal falls in a range from the second value to a maximum value.

2. A display device according to claim 1, wherein the average value of the positive-side gray scale voltage and the negative-side gray scale voltage, with respect to the signal amplitude of the video signal, assumes an upper extreme value at a point where the average value changes from increasing values to decreasing values and a lower extreme value at a point where the average value changes from decreasing values to increasing values in the range from the minimum value to the maximum value of the signal amplitude of the video signal.

3. A display device according to claim 2, wherein the average value of the positive-side gray scale voltage and the negative-side gray scale voltage, with respect to the signal amplitude of the video signal, in the range of values between the lower extreme value and the upper extreme value, is changed monotonously.

4. A display device according to claim 2, wherein the average value of the positive-side gray scale voltage and the negative-side gray scale voltage is changed monotonously from the value thereof at the minimum value of the signal amplitude of the video signal to said upper extreme value and from said lower extreme value thereof to the value thereof at the maximum value of the signal amplitude of the video signal.

5. A display device according to claim 4, wherein the average value of the positive-side gray scale voltage and the negative-side gray scale voltage at the minimum signal amplitude of the video signal is smaller than the average value of the positive-side gray scale voltage and the negative-side gray scale voltage at said lower extreme value.

6. A display device according to claim 4, wherein the average value of the positive-side gray scale voltage and the negative-side gray scale voltage at the maximum signal amplitude of the video signal is larger than the average value of the positive-side gray scale voltage and the negative-side gray scale voltage at said upper extreme value.

7. A display device comprising:

a display area including a plurality of gate signal lines and a plurality of drain signal lines crossing the plurality of gate signal lines, and a plurality of pixel regions surrounding the plurality of gate signal lines and the plurality of drain signal lines;

a plurality of common counter voltage signal lines arranged in the respective pixel regions;

a pixel electrode and a counter electrode arranged in the respective pixel regions, and wherein the display device supplies a video signal to the pixel electrode through each of the plurality of drain signal lines and the display device supplies a reference signal, which becomes a reference with respect to the video signal, to the counter electrode through each of the plurality of common counter voltage signal lines in each pixel, wherein the display device produces a positive-side gray scale voltage and a negative-side gray scale voltage with respect to the reference signal applied to the counter electrode, and wherein the display device controls the average value of the positive-side gray scale voltage and the negative-side gray scale voltage such that:

(a) the average value of the positive-side gray scale voltage and the negative-side gray scale voltage is increased when a display gray scale of the video signal falls in a range from a minimum value to a first value, (b) the average value of the positive-side gray scale voltage and the negative-side gray scale voltage is decreased when a signal amplitude of the video signal falls in a range from the first value to a second value, and (c) the average value of the positive-side gray scale voltage and the negative-side gray scale voltage is increased when the display gray scale of the video signal falls in a range from the second value to a maximum value.

8. A display device according to claim 7, wherein the average value of the positive-side gray scale voltage and the negative-side gray scale voltage, with respect to the signal amplitude of the video signal, assumes an upper extreme value at a point where the average value changes from increasing values to decreasing values and a lower extreme value at a point where the average value changes from decreasing values to increasing values in the range from the minimum value to the maximum value of the display gray scale of the video signal.

9. A display device according to claim 8, wherein the average value of the positive-side gray scale voltage and the negative-side gray scale voltage, with respect to the signal amplitude of the video signal, in the range of values between the lower extreme value and the upper extreme value, is changed monotonously.

10. A display device according to claim 9, wherein the average value of the positive-side gray scale voltage and the negative-side gray scale voltage at the minimum display gray scale of the video signal is smaller than the average value of the positive-side gray scale voltage and the negative-side gray scale voltage at said lower extreme value.

11. A display device according to claim 9, wherein the average value of the positive-side gray scale voltage and the negative-side gray scale voltage at the maximum display gray scale of the video signal is larger than the average value of the positive-side gray scale voltage and the negative-side gray scale voltage at said upper extreme value.

12. A display device according to claim 11, wherein the display device is driven in a normally white mode in which the minimum value of the display gray scale assumes a white display and the maximum value of the display gray scale assumes a black display.

13. A display device according to claim 11, wherein the display device is driven in a normally black mode in which the minimum value of the display gray scale assumes a black display and the maximum value of the display gray scale assumes a white display.

14. A display device according to claim 1, wherein a circuit which forms the respective gray scale voltages includes gray scale division resistances and the resistances are constituted of seven or more resistances.

15. A display device according to claim 14, wherein a resultant resistance of the gray scale resistances between positive-polarity voltage outputs is larger than a resultant resistance of the gray scale resistances between negative-polarity voltage outputs.

16. A display device according to claim 7, wherein a circuit which forms the respective gray scale voltages includes gray scale division resistances and the resistances are constituted of seven or more resistances.

17. A display device according to claim 16, wherein a resultant resistance of the gray scale voltages between positive-polarity outputs is larger than a resultant resistance of the gray scale voltages between negative-polarity outputs.

18. A method of driving a display device which includes a pixel electrode to which a video signal is supplied and a counter electrode to which a reference signal, which becomes a reference with respect to the video signal, is supplied in each pixel, and wherein a positive-side gray scale voltage and a negative-side gray scale voltage are formed with respect to the reference signal applied to the counter electrode, the method comprising the steps of:

(a) increasing an average value of the positive-side gray scale voltage and the negative-side gray scale voltage when a signal amplitude of the video signal falls in a range from a minimum value to a first value, (b) decreasing the average value of the positive-side gray scale voltage and the negative-side gray scale voltage when the signal amplitude of the video signal falls in a range from the first value to a second value, and (c) increasing the average value of the positive-side gray scale voltage and the negative-side gray scale voltage when the signal amplitude of the video signal falls in a range from the second value to a maximum value.

* * * * *